US005272503A

United States Patent [19]

LeSueur et al.

[11] Patent Number: 5,272,503

[45] Date of Patent: Dec. 21, 1993

[54] REPLACEABLE SUB-ASSEMBLIES FOR ELECTROSTATOGRAPHIC REPRODUCING MACHINES

[75] Inventors: Eric J. LeSueur, Wembley; Krzysztof J. Less, London; Robin A. Collins, Biggleswade; Shelley M. Taylor, Stevenage, all of United Kingdom

[73] Assignee: Xerox Corporation, Stamford, Conn.

[21] Appl. No.: 939,193

[22] Filed: Sep. 2, 1992

[51] Int. Cl.[5] ..... G03G 15/00

[52] U.S. Cl. ..... 355/208; 355/210

[58] Field of Search ..... 355/208, 210, 211, 209, 355/246, 203, 308, 260

[56] References Cited

U.S. PATENT DOCUMENTS

| | | | |
|---|---|---|---|
| 3,575,505 | 4/1971 | Parmigiani | 355/246 |
| 4,136,945 | 1/1979 | Stephens | 355/208 |
| 4,500,195 | 2/1985 | Hosono | 355/208 |
| 4,666,290 | 5/1987 | Yoshiura | 355/209 |
| 4,707,748 | 11/1987 | Ohtsuka et al. | 355/209 X |
| 4,827,308 | 5/1989 | Howard et al. | 355/271 |
| 4,896,184 | 1/1990 | Kamitamari et al. | 355/206 |
| 4,961,088 | 10/1990 | Gilliland et al. | 355/206 |
| 4,974,020 | 11/1990 | Takamatsu et al. | 355/208 |
| 5,021,828 | 6/1991 | Yamaguchi et al. | 355/209 |

FOREIGN PATENT DOCUMENTS 2216437A 10/1989 United Kingdom .

*Primary Examiner*—Joan H. Pendegrass

[57] ABSTRACT

A printing machine, having operating parameters associated therewith, for producing prints is provided. The printing machine includes a controller for controlling the operating parameters and an operator replaceable sub-assembly adapted to serve as a processing station in the printing machine. The operator replaceable sub-assembly includes a memory device, communicating with the controller when the replaceable sub-assembly is coupled with the printing machine, for storing a value which varies as a function of the usage of the replaceable sub-assembly, the controller adjusting a selected one of the operating parameters in accordance with the stored value for maintaining printing quality of the printing machine.

9 Claims, 5 Drawing Sheets

REPLACEABLE SUB-ASSEMBLIES FOR ELECTROSTATOGRAPHIC REPRODUCING MACHINES

The present invention relates generally to a printing machine, and more particularly to a technique for controlling operating parameters thereof.

Some printing machines use replaceable sub-assemblies, or cartridges. For example, a photoreceptor for a printing machine and its supporting hardware can be assembled into a process unit which can be removed from the machine and replaced by a new unit as required. Similarly, developer cartridges and toner supply cartridges can be provided.

One form of replaceable unit for a printing machine is described in the following patent:

U.S. Pat. No. 4,827,308;
Patentee: Howard et al.;
Issued: May 2, 1989.

U.S. Pat. No. 4,827,308 discloses that the unit preferably contains a belt photoreceptor and various processing means, namely a development device, a transfer corotron, a cleaner and a charge corotron.

The following references also relate to replaceable units for printing machines:

U.S. Pat. No. 4,500,195;
Patentee: Hosono;
Issued: Feb. 19, 1985.
U.S. Pat. No. 4,666,290;
Patentee: Yoshiura;
Issued: May 19, 1987.
U.S. Pat. No. 4,896,184;
Patentee: Kamitamari et al.;
Issued: Jan. 23, 1990.
U.S. Pat. No. 4,961,088;
Patentee: Gilliland et al.;
Issued: Oct. 2, 1990.
U.S. Pat. No. 5,021,828;
Patentee: Yamaguchi et al.;
Issued: Jun. 4, 1991.
U.K. Patent Application;
Publication No. 2 216 437;
Publication Date: Oct. 11, 1989;
Applicants: Midorikawa et al.;
Filing Date: Feb. 24, 1989.

U.S. Pat. No. 4,666,290 discloses a toner cartridge having a "color display unit", in the form of a piece of colored material, which identifies the color of the toner in the cartridge. When the cartridge is inserted in a copier, it causes a lamp to be switched on, sending light through the display unit, for showing the operator the color of the toner that is in use. Some of the light is reflected from the display unit to a sensor connected to a CPU of the copier for adjusting the copier operating parameters in dependence on the color of the toner.

U.S. Pat. No. 4,500,195 discloses a replaceable unit for an image forming apparatus, comprising a photosensitive drum, a toner supply cartridge and a toner recovery container. When the replaceable unit is manufactured, an arm on the outside of the unit is set to a certain position dependent on the characteristics of the photosensitive drum. When the unit is inserted in the machine, the arm automatically sets the machine to operate under the most appropriate image forming conditions.

U.S. Pat. No. 4,896,184 describes an arrangement in which a toner cartridge is provided with a pair of sensors, such as pressure sensors, which sense whether or not the toner within the cartridge is level. The sensors provide an output to the machine in which the cartridge is used, to prevent copying taking place if the toner is not level enough to give satisfactory copies.

U.S. Pat. No. 4,961,088 discloses a printing machine that employs a xerographic cartridge, a developer cartridge and a toner cartridge. Each cartridge has an identification/memory chip in the form of an EEPROM (Electrically Erasable Progammable Read Only Memory) integral therewith, which is electrically connected with the machine when the cartridge is inserted. The EEPROM ensures that only authorized cartridges are used in the machine, and it also maintains a running count of the number of images made while a cartridge is in use so that a cartridge can be disabled when it reaches the end of its life.

U.S. Pat. No. 5,021,828 discloses an apparatus with a main body to which a consumable part can be detachably loaded, counting means for counting the number of copies made with a specific consumable part being loaded in a main body of the apparatus, state detecting means for detecting the level of consumption that is indicated by the consumable part, and life-time decision means for deciding the life-time of the consumable part on the basis of the detection result from the state detecting means and the count value from the count means. The counted value from the counting means and the result of the state detection means are used together in supervising the life-time of the consumable part.

The U.K. Patent Application discloses a toner cartridge provided with some form of identification which can be sensed by the copier in which the cartridge is used. The identification indicates to the copier the type of toner that the cartridge contains and causes an operating parameter of the copier (for example, fuser roll temperature) to be adjusted accordingly. Alternatively, if the toner is of a type that should not be used in the copier, an alarm signal may be produced.

A replaceable sub-assembly for a printing machine does not necessarily remain in place in a printing machine continuously for the whole of the sub-assembly's useful life. For example, if a different color of toner is required, a sub-assembly may be removed and temporarily replaced by another. It would be desirable to provide a replaceable sub-assembly which performs optimally regardless of how often it is removed from a machine or how many different machines the sub-assembly is used in throughout its life.

In accordance with the invention, there is provided a printing machine, having operating parameters associated therewith, for producing prints, comprising: a controller for controlling the operating parameters; and an operator replaceable sub-assembly adapted to serve as a processing station in the printing machine, the operator replaceable sub-assembly including a memory device, communicating with the controller when the replaceable sub-assembly is coupled with the printing machine, for storing a value which varies as a function of the usage of the replaceable sub-assembly, the controller adjusting a selected one of the operating parameters in accordance with the stored value for maintaining printing quality of the printing machine.

These and other aspects of the invention will become apparent from the following description, the description being used to illustrate a preferred embodiment of the invention when read in conjunction with the accompanying drawings.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
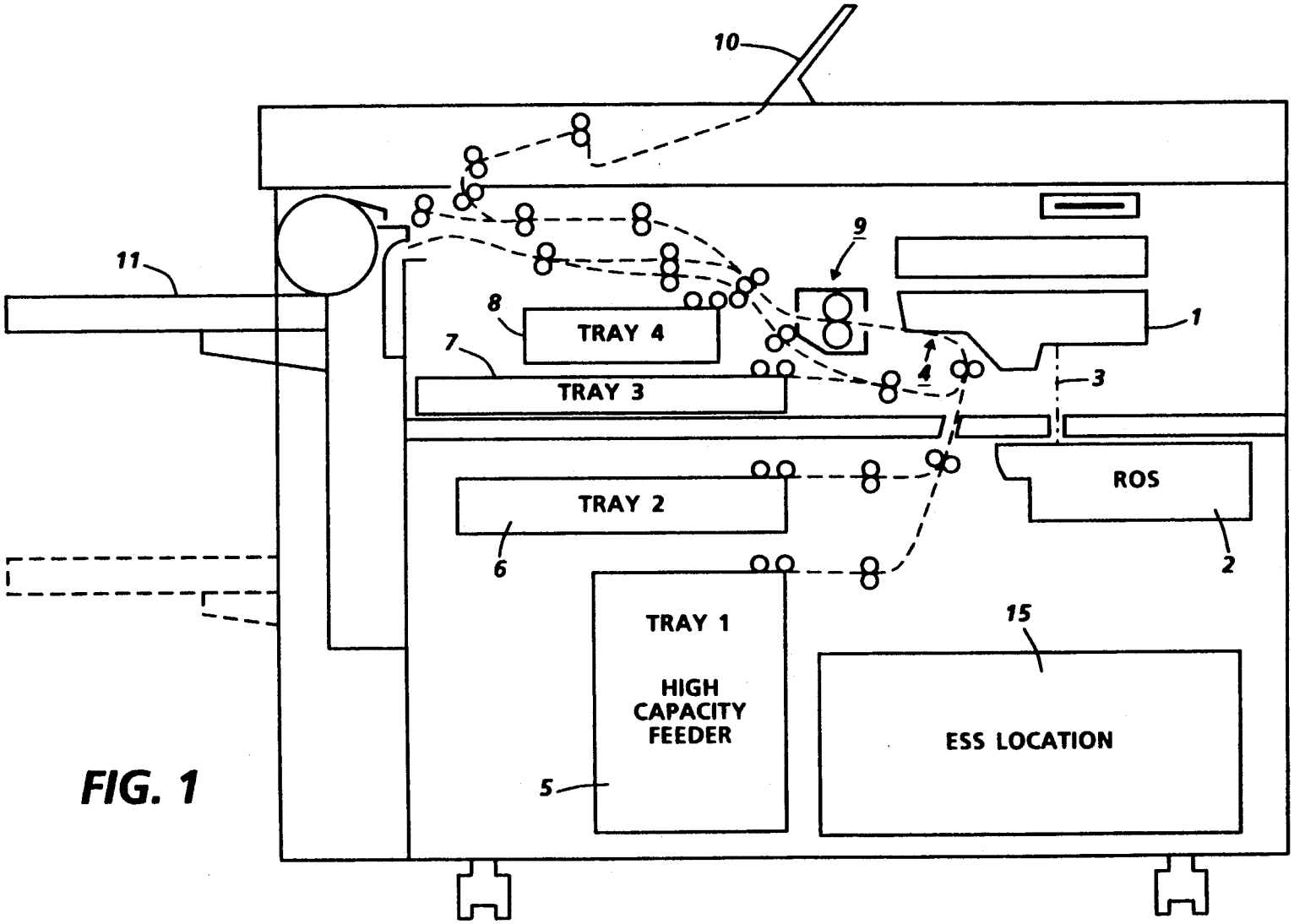
FIG. 1 is a schematic, diagrammatic view of a printing machine.
Figure 2:
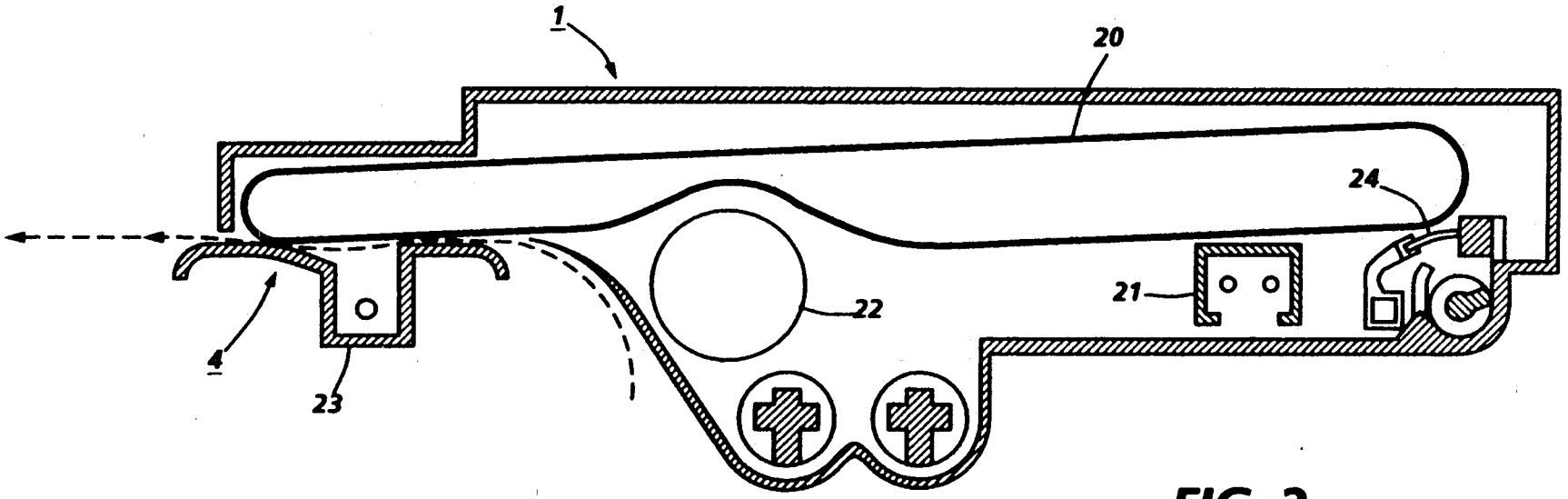
FIG. 2 is a schematic cross-sectional view of a replaceable sub-assembly for the printing machine of FIG. 1.
Figure 3:
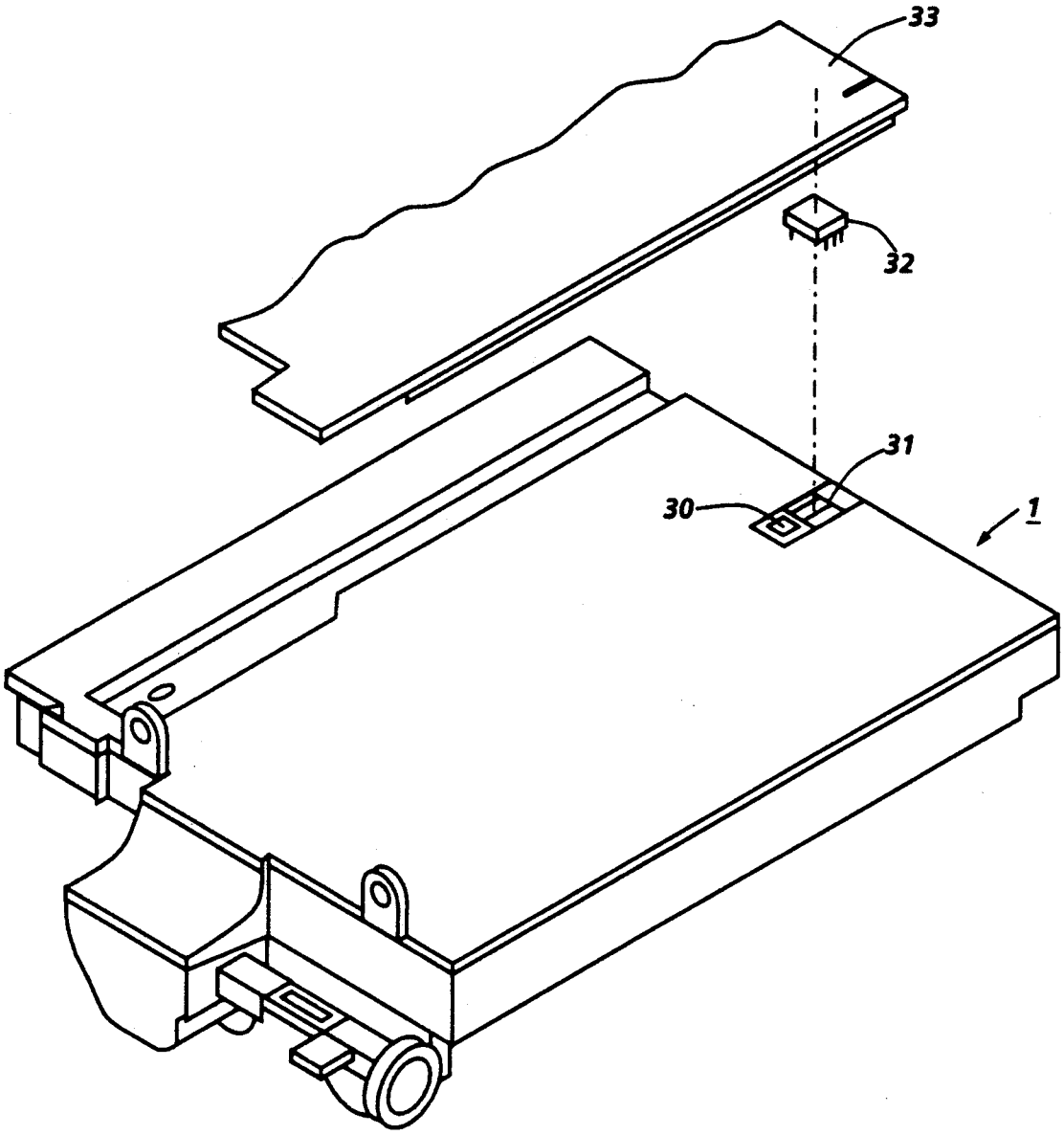
FIG. 3 is a perspective view of the replaceable sub-assembly of FIG. 2 in which the connection of the replaceable sub-assembly to the printing machine is shown by way of a partial view.

FIG. 1 shows a laser printer employing a replaceable sub-assembly in the form of a xerographic cassette 1 which is shown in greater detail in FIGS. 2 and 3. A xerographic imaging member in the form of an endless flexible photoreceptor belt is housed within the cassette 1, together with other xerographic process means as described below. A raster output scanner (ROS) 2 provides an imaging beam 3 which is directed at the photoreceptor belt through an imaging slit in the cassette 1 to form an electrostatic latent image on the belt. The image is developed within the cassette and is transferred, at a transfer station 4, to a copy sheet which is fed to that location from one of four supply trays 5, 6, 7 and 8. The transferred image is fused to the copy sheet at a fusing station 9 and the copy sheet may then be delivered from the printer to be collected either in a sample tray 10 on top of the machine or in a stacking tray on the side of the machine. Alternatively, a copy sheet with a fused image on one side only may be put into a trayless duplex path within the machine, to be returned to the transfer station 4 to receive an image on the other side before being delivered from the machine into one of the trays 10, 11.

The raster output scanner 2 incorporates a He-Ne laser to generate the imaging beam 3, a conventional rotating polygon device to sweep the beam across the surface of the photoreceptor belt, and an acoustic modulator. The beam is modulated in accordance with input signals received from a remote image source, for example, a user interface and keyboard (not shown). The operation of a raster output scanner of that type to generate a latent image on a photoreceptor is well understood and need not be described here. The processing of the image signals from the remote source is handled by an electronic sub-system of the printer, indicated at 15, while operation of the printer generally is under the control of a machine control unit (not shown) which includes one or more microprocessors and suitable memories, for holding the machine operating software.

The cassette 1 may be similar to that described in U.S. Pat. No. 4,827,308. In addition to the photoreceptor belt 20, it includes a charge scorotron 21; a developer device 22; a transfer corotron 23 and a cleaning device 24. The charge scorotron 21 is located upstream of the imaging slit in the cassette to deposit a uniform electrostatic charge on the surface of the belt before it is exposed to the imaging beam 3. The developer device 22 is located downstream of the imaging slit to bring developer mixture into proximity with, and thereby develop, the electrostatic latent image on the belt. The developer mixture is a two-component mixture comprising toner and a magnetically-attractable carrier. Toner is transferred to the belt 20 during image development and replacement toner is dispensed periodically from a hopper (not shown) into the housing of the developer device 22. The transfer corotron 23 is located at the transfer station 4 to assist in transferring the developed image from the belt to the copy sheet which enters the cassette at that point. Finally, the cleaning device 24 removes any residual toner particles from the surface of the photoreceptor belt which is then illuminated by a discharge lamp to remove any electrostatic charge remaining on the belt.

The cassette 1, as already mentioned, is removable from the printer and can be replaced by another cassette if any of the process elements begins to deteriorate. Alternatively, it can be replaced by a cassette which contains toner of a different colour.

The cassette 1 has a memory chip 30, shown in FIG. 3, in the form of an EEPROM (Electrically Erasable Programmable Read Only Memory) mounted in the top cover of the cassette. Contact pads 31 are provided on the chip so that, when the cassette is inserted into the printer, the chip is automatically connected to the machine control unit via a terminal block 32 on a part 33 of the printer. When inserted in the printer, the memory 30 receives information from the printer control unit reflecting the usage (and hence the age) of the cassette 1, and stores that information. For example, the memory 30 may receive and store information concerning the number of prints made while the cassette is in position in the printer, that information being retained if the cassette is removed from the printer for any reason. That information is, in turn, utilized to adjust one or more operating parameters of the xerographic system of the printer to take account of the age of the cassette and thereby to enable the output quality of the printer to be maintained and the operating life of the cassette to be prolonged. The operating parameters that may be adjusted in dependence on the information stored in the memory 30 include, for example, photoreceptor charge level, exposure level, developer bias level and the response level of the ADC (automatic density control) system.

Throughout normal operation of the printer, the ADC system regularly measures the toner density in the prints produced and signals the printer control unit to operate the toner dispensing motor to supply toner to the developer device 22 when necessary. The response of the control unit, and hence the amount of toner dispensed, is determined by the so-called ADC "setpoint" in the machine memory. Automatic density control systems for use in printing machines are well known and need not be described in detail here. A known type of automatic density control system comprises means for generating a test patch on the photoreceptor and a sensor for measuring the reflectance of the developed patch to determine the toner density: one such system is described, for example, in U.S. Pat. No. 4,551,004, and a test patch generator suitable for a laser printer of the type shown in FIG. 1 is described in U.S. patent application Ser. No. 07/755,193, entitled "ROS Assisted Toner Patch Generation for Use in Tri-Level Imaging,"

filed Sep. 5, 1991, the pertinent portions of which are incorporated herein.

Figure 4:
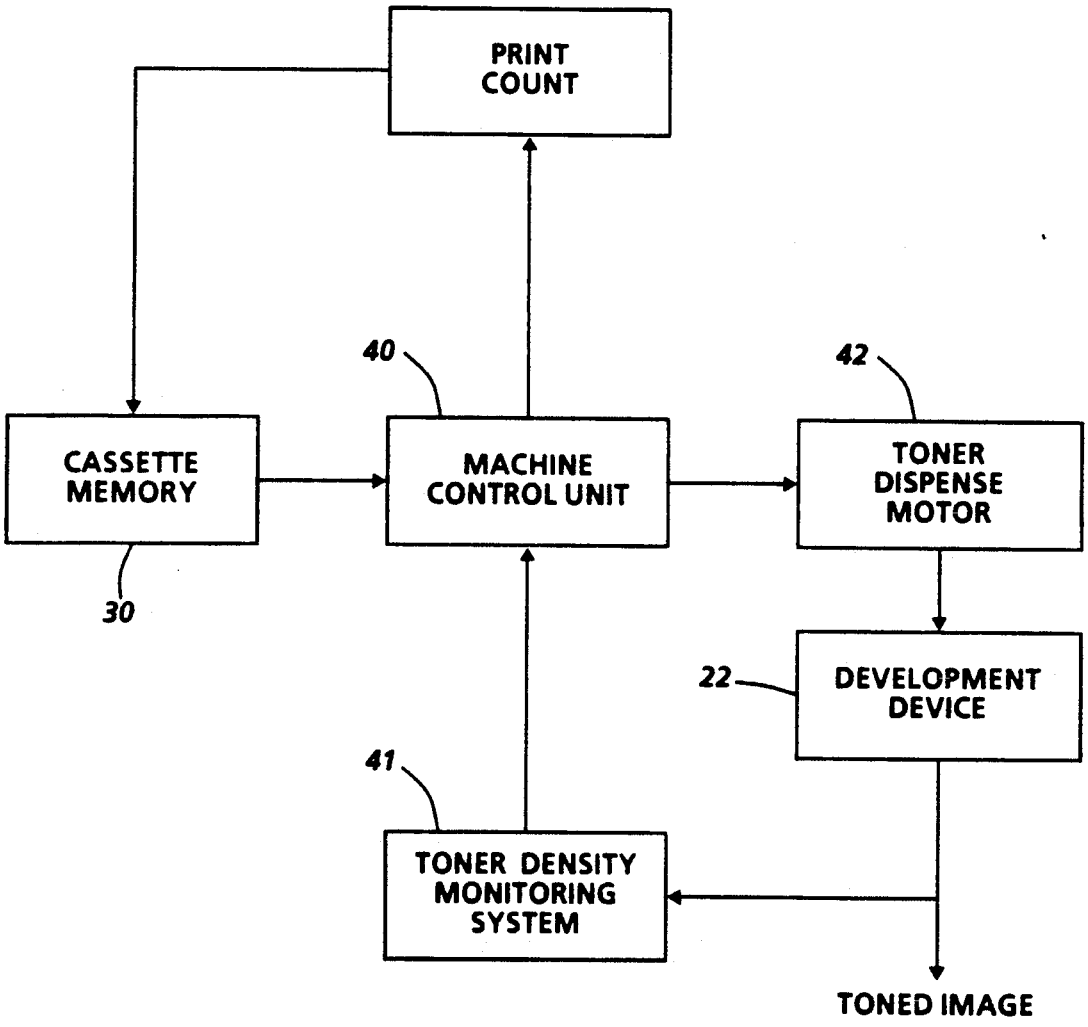
FIG. 4 is a block diagram showing the relationship of various parts of the printing machine to one another.

As the age of the cassette 1 increases, the development characteristics of the developer device 22 may change, leading to, for example, deterioration of the line development performance of the printer even through the solid area development capability may remain constant due to the action of the ADC system. It is however possible to regain the line development performance at the expense of the solid area development (SAD) performance by adjusting the ADC setpoint as the cassette ages, so that the line development performance stays constant with age but the SAD performance changes instead. Thus, one possible use of the information contained in the cassette memory 30 is to enable such adjustment of the ADC setpoint to be carried out. When the cassette shown in FIGS. 2 and 3 are inserted in the printer, the machine control unit is immediately supplied with information concerning the age of the cassette and at regular intervals in the life of the cassette (as monitored by the machine controller in conjunction with the memory device 30), when it is estimated that the line density performance will have drifted away from its intended performance level, the ADC setpoint is adjusted to restore the line development performance. That is illustrated in FIG. 4 which shows the machine control unit 40 with an input from the conventional automatic density sensor 41 and also from the cassette memory 30. The response of the machine control unit to the signal from the sensor 41 is adjusted in accordance with the input from the cassette memory 30 and in turn adjusts the operation of the toner dispensing motor 42.

The change in the SAD performance which results from the above-described procedure may, however, be unacceptable. If so, a similar procedure can be used to change other parameters such as the photoreceptor charge level, the exposure level and the developer bias voltage, in dependence on the age of the cassette 1, at the same time as changing the ADC setpoint so that the line development performance and the SAD performance are both satisfactory. More particularly, for any cassette age, it is possible to select values of the ADC setpoint, the photoreceptor charge level, the exposure level and the developer bias voltage such that both the line development performance and the SAD performance meet their requirements. For each additional parameter that is to be adjusted, the appropriate control loop would appear in FIG. 4 in parallel with the loop 42, 22, 41.

Another effect that may occur as the cassette 1 ages is that the concentration of toner in the sump of the developer device drops even though the print quality parameters are satisfied. Use of the cassette at such reduced toner concentration levels may cause a shortening of the life of the developer material and thus of the cassette. The adjustment of parameters as described above can also be used to counteract such effects, so that not only are all the print quality parameters at their desired levels for any cassette age, but the toner concentration is also at its desired level, thus prolonging the usable life of the cassette.

Such optimum operating parameters may be determined from experimental and theoretical data on a number of sample systems and held as look-up tables or algorithms in the machine control unit. The storing of the age of the cassette in the memory device 30 makes it possible to use such correction tables and algorithms with accuracy and confidence, since the age of the cassette is stored even when the cassette is withdrawn from the machine, and is retrieved by the machine upon re-installing the cassette into the machine.

Figure 5:
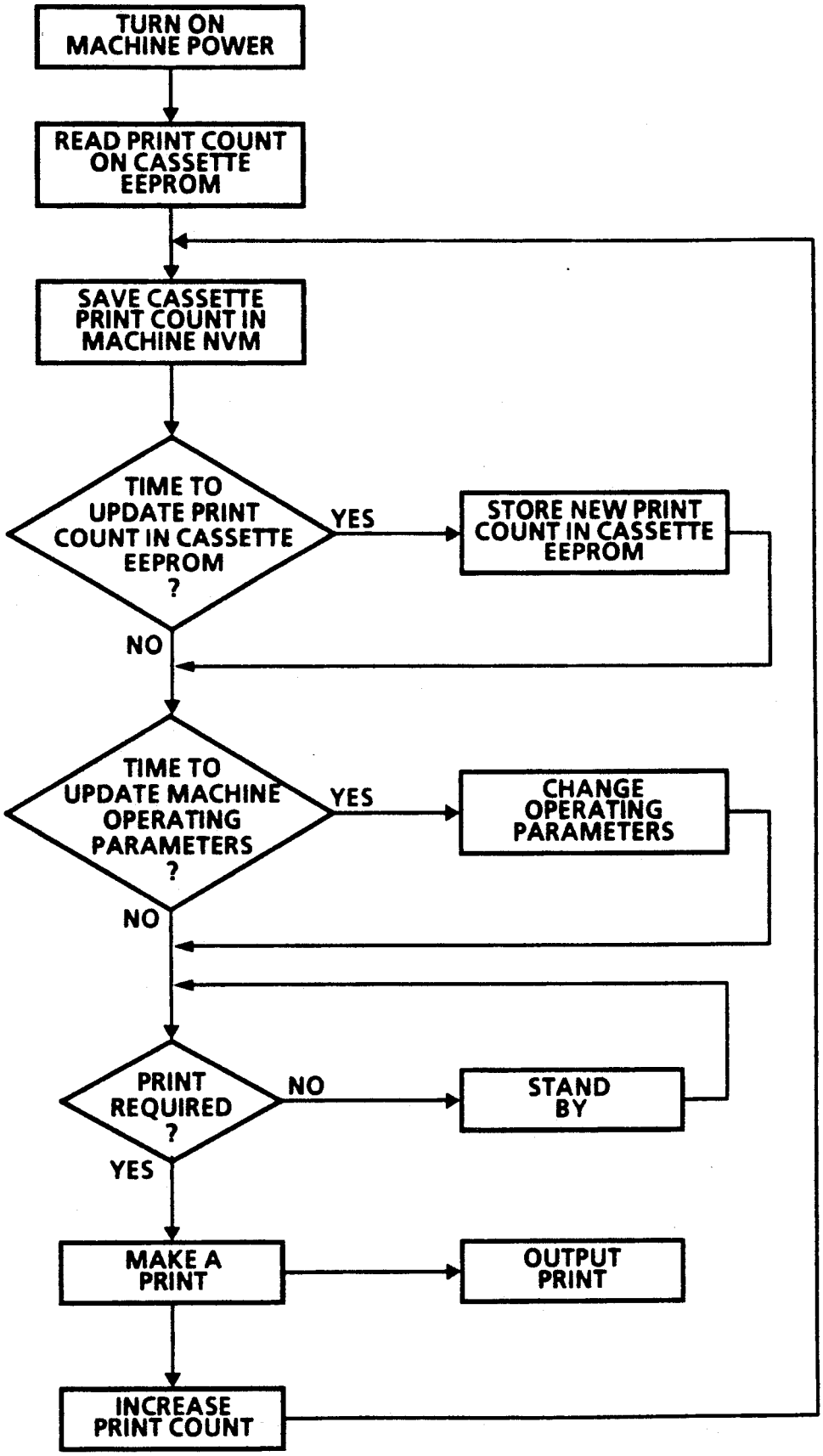
FIG. 5 is a flow diagram illustrating a preferred mode of operation for the present invention.

Referring to FIG. 5, whenever the printer is powered up, the print count stored in the cassette memory 30 is read and stored in a non-volatile memory (NVM) in the machine control unit 40. The machine is programmed to update the print count in the cassette memory periodically and, if the machine determines that an update is due, the new value is written back into the cassette memory 30 where it is retained even if the cassette is then removed from the machine. For example, the cassette memory may be updated whenever the machine control unit determines that 200 prints have been made since the cassette memory was previously updated. The machine control unit then examines the cassette print count to determine whether or not it has reached a value at which the operating parameters of the xerographic system should be adjusted. The control unit may, for example, be programmed to adjust the operating parameters when the machine control unit determines that 8000 prints have been made since the previous adjustment. Thereafter, on receipt of a print request, the machine control unit 40 counts the number of prints made and, when a print run is completed, stores the total number of prints made during that run for use in updating the cassette print count as already described. Alternatively, the cassette print count could be updated during, rather than at the end of, a print run.

Because the machine is supplied with information regarding the age of a cassette and can compensate for changes that occur as the development system ages, an improved performance can be achieved together with more efficient use of the available toner in the cassette.

Although the above description refers to the age of a cassette being related to the accumulated number of prints made while the cassette is in use, other factors could be used to indicate the age of a cassette. For example, the cassette memory 30 could store the number of revolutions of the photoreceptor belt or the number of charge cycles that occur in the cassette, both of which indirectly indicate the number of prints made, or it could store the area coverage (as represented by the number of pixels toned) while the cassette is in use. Alternatively, the cassette memory 30 could be supplied continuously with, and store, information concerning the difference between the intended and the actual charge on the photoreceptor 20 as an indication of the age of the cassette 1. When the cassette is removed from the printer, for example, because a cassette containing toner of a different colour is required, the most recent measurement indicating the age of the cassette is stored and is immediately available for use by the machine controller as already described.

Although the above description refers to the cassette of FIGS. 2 and 3 as being used in a laser printer, that is not essential. A cassette incorporating a memory for storing information concerning the age of the cassette could be used, for example, in an electrostatographic copier which could be of the type described in U.S. Pat. No. 4,827,308. Moreover, the cassette need not be of the type described above. The cassette could, for example, simply be a toner cassette and need not include the photoreceptor of the machine.

A cassette of the type described above could be used in a printer of the type described in U.S. Pat. No. 5,204,698 to Lesueur et al, the pertinent portions of which are incorporated herein. In that patent application the number of pixels to be toned in a photoreceptor cycle is used to indicate the amount of toner that should be dispensed to the developer device 22 during that cycle. In that printer, the toner density monitoring system is used to provide additional control over the amount of toner that is dispensed to the developer device 22 in any given photoreceptor cycle.

What is claimed is:

1. A printing machine, having operating parameters associated therewith, for producing prints, comprising:

a controller for controlling the operating parameters;

an operator replaceable sub-assembly adapted to serve as a processing station in the printing machine, said operator replaceable sub-assembly including a memory device, communicating with said controller when said replaceable sub-assembly is coupled with said printing machine, for storing a value which varies as a function of the usage of said replaceable sub-assembly, said controller adjusting a selected one of the operating parameters in accordance with the stored value for maintaining printing quality, wherein said memory device is updated by said controller in response to a predetermined period of sub-assembly usage and the operating parameter is adjusted in response to the predetermined period of sub-assembly usage; and means, operatively associated with said controller and responsive to the stored value, for determining the level to which the selected one of the operating parameters should be adjusted.

2. The printing machine of claim 1, wherein said operator replaceable sub-assembly includes:

an imaging member adapted to have a latent image recorded thereon; and means for developing the latent image with developer material.

3. The printing machine of claim 2, wherein the value represents a number of latent images developed by said developing means.

4. The printing machine of claim 2, wherein the value indicates an operating condition associated with said imaging member.

5. The printing machine of claim 4, wherein the operating condition comprises a level to which the imaging member can be charged and a level to which the imaging member can be exposed.

6. A printing machine, having operating parameters associated therewith, for producing prints, comprising:

a controller for controlling the operating parameters; and an operator replaceable sub-assembly adapted to serve as a processing station in the printing machine, said operator replaceable sub-assembly including a memory device, communicating with said controller when said replaceable sub-assembly is coupled with said printing machine, for storing a value which varies as a function of the usage of said replaceable sub-assembly, said controller adjusting a selected one of the operating parameters in accordance with the stored value for maintaining printing quality, wherein said operator replaceable sub-assembly includes an imaging member adapted to have a latent image recorded thereon and means for developing the latent image with developer material, and wherein the value represents an image area on which developer material has been deposited by said developing means.

7. A method of controlling operating parameters of a printing machine which has a controller and produces prints, comprising:

a) selectively coupling a replaceable sub-assembly, with a memory device, to the printer, wherein the memory device communicates with the controller;

b) storing a value, which varies as a function of sub-assembly usage, in the memory device;

c) in view of the stored value, determining the level to which a selected one of the operating parameters should be adjusted;

d) adjusting the selected one of the operating parameters with the controller in accordance with the determined level of adjustment for maintaining printing quality of the printing machine;

e) updating the memory device with the controller after a predetermined period of sub-assembly usage; and f) repeating steps c–e after a predetermined period of sub-assembly usage.

8. The method of claim 7, in which the sub-assembly includes a developing unit adapted to develop a latent image recorded on an imaging member with toner, and the developing unit has an operating parameter associated therewith, wherein said adjusting step comprises adjusting the operating parameter associated with the developing unit with the value.

9. The method of claim 8, in which the imaging member has an operating parameter associated therewith, wherein said adjusting step comprises adjusting the operating parameter associated with the imaging member with the value.

* * * * *